US006299381B1

(12) United States Patent
Liebrecht, Jr.

(10) Patent No.: US 6,299,381 B1
(45) Date of Patent: Oct. 9, 2001

(54) TRENCHER PLOW FOR LAYING PIPE

(76) Inventor: Sylvester J. Liebrecht, Jr., Rt. #2, 17771 Rd. H13, Continental, OH (US) 45831

( * ) Notice: Subject to any disclaimer, the term of this patent is extended or adjusted under 35 U.S.C. 154(b) by 0 days.

(21) Appl. No.: 09/502,679

(22) Filed: Feb. 11, 2000

(51) Int. Cl.[7] ..... E02F 5/10

(52) U.S. Cl. ..... 405/181; 37/350

(58) Field of Search ..... 405/181, 180, 405/174; 37/350, 365, 367, 366

(56) References Cited

U.S. PATENT DOCUMENTS 3,443,326 * 5/1969 Saumenig ..... 37/350

* cited by examiner

*Primary Examiner*—Christopher J. Novosad
(74) *Attorney, Agent, or Firm*—Charles F. Schroeder

(57) ABSTRACT

A trencher plow for laying pipe such as drainage pipe which includes in combination an auger angled downwardly toward a plow which follows, both mounted in a superstructure and being arranged to be cooperatively raised and to set the grade and depth of cut by the plow determinable by sensing the grade setting signal of a laser unit located in the field of cut. The auger is provided with cutting lobes distributed about its teeth which facilitate cutting and throwing soil to the sides of a trench being dug in advance of the plow which finalizes shaping of the trench for deposition of pipe into the trench.

22 Claims, 3 Drawing Sheets

TRENCHER PLOW FOR LAYING PIPE

FIELD AND BACKGROUND OF THE INVENTION

The present invention is a new trencher plow for laying flexible pipe such as drainage pipes having perforations for subsurface drainage. The invention includes, in combination, a plow and a horizontal auger mounted in a frame or superstructure in which the plow is supported over the auger. In operation the auger is angled downwardly toward a cutting boot on the plow such angle being about 60 degrees dependant upon the depth of the trench being dug by the plow drawn immediately behind.

The auger of the invention having the usual helically distributed and angled teeth is uniquely provided with spaced projections such as lobes mounted on its teeth which during the auger rotation are effective in digging into soil. At operating speeds of the invention, the auger with its lobes is effective in throwing the soil to both sides of a trench being formed. The boot of the plow following immediately behind the auger is selected to have a width adequate to form a trench for the diameter of flexible pipe being laid. In this respect the auger acts to loosen and remove the soil in advance of the plow in preparation for final shaping of the trench by the plow. The auger is usually operated just above the level of the cut of the plow, and the plow then finishes the shaping of the trench for laying of flexible pipe thereafter.

It has been found that such cooperative operation of the auger and the plow reduces the energy requirements to form the trench to the extent that the trencher can be drawn by an ordinary farm tractor. In this respect the machine of the invention eliminates the need for two separate self driven machines namely, an auger operating machine and a separate trencher machine each driven by its own power source, which are each usually quite costly. The new machine is adaptable to being built with its own self built-in power source in which case it has been found that the power requirements are much less than the power of separate commercially available machines. Although separate commercially available self powered auger and trencher machines can be designed to operate at somewhat faster speeds, the need in most instances is not for such faster speed.

An object of the invention is to provide a trencher plow machine for laying flexible pipe which is efficient in power requirements such that it can be drawn by a conventional farm tractor.

Another object of the invention is to provide a trencher plow machine for laying pipe which is relatively simple in construction, easy to operate and low in cost compared to existing commercially available machines for such purposes.

A further object of the invention is to provide a trencher machine which by selective attachment of an appropriate plow boot is adaptable to laying flexible pipe of any of a range of sizes of pipe.

Still another object of the invention is to provide a trencher which tosses the soil to the side of a trench as it is being formed in preparation for a clean sweep by a plow in shaping the trench.

A feature of the invention is that the trencher is adaptable to being guided by a laser in forming trenches for laying pipe with a desired grade.

Another feature of the invention that the machine includes automatic adjustment for lateral tilt to assure proper operation and shaping of a trench.

A further feature of the invention is the unique provision of lobes on the auger which facilitates digging into the soil and tossing it to the sides of a trench being formed.

Still another feature of the invention lies in the fact that the auger in combination with the plow lends itself to low power consumption such that the machine can be drawn by a conventional farm tractor.

Other objects and structural features which are believed to be characteristic of my invention are set forth with particularity in the appended claims. My invention, together with further objects and features thereof may be best understood by reference to the following description taken in connection with the accompanying drawings.

THE DRAWINGS

DETAILS OF THE INVENTION

Figure 1:
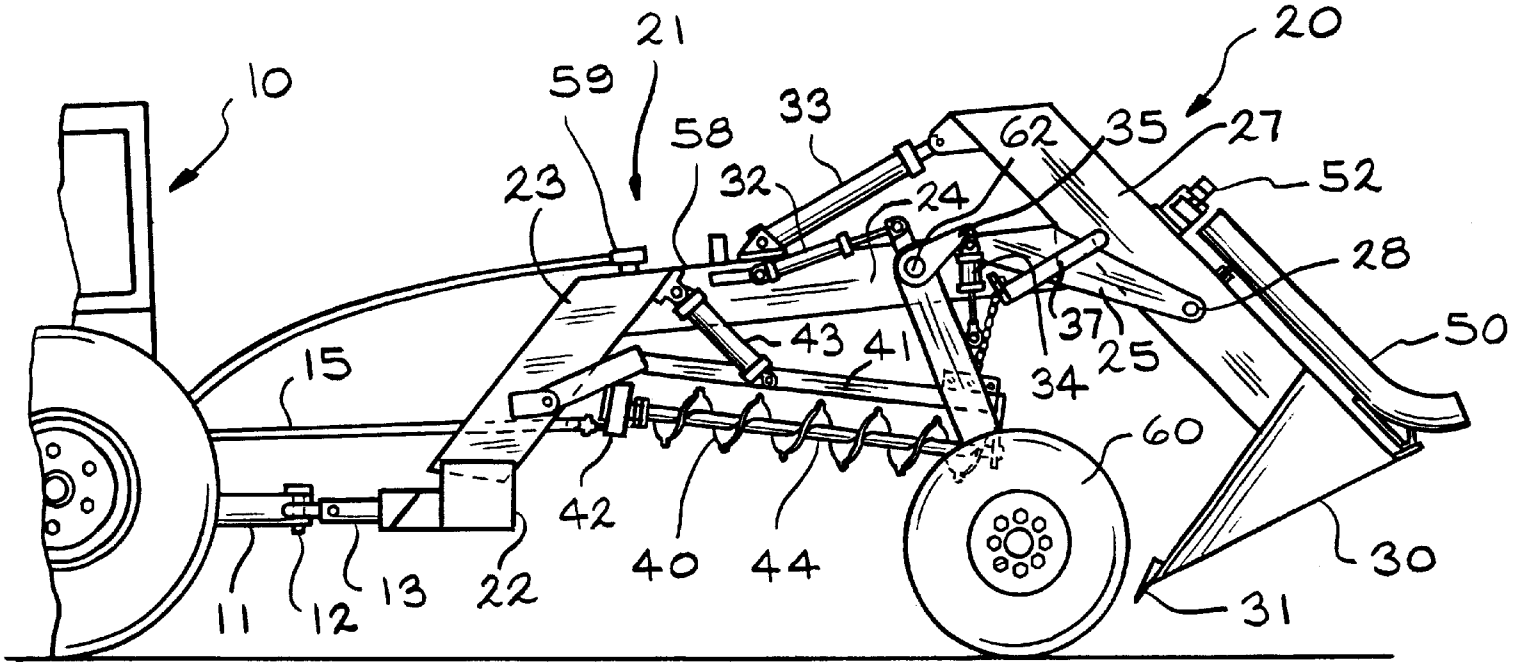
FIG. 1 is a side elevation view of a trencher plow machine of the invention shown as it is connected to the rear of the tractor, shown in part, for transportation from location to location.

Turning to the drawings in greater detail, FIG. 1 illustrates an exemplary form of the machine of the invention connected to be drawn by a tractor 10, with only the rear portion shown, having a towbar 11 connected by a coupling 12 to a pull shaft 13 for the trencher plow machine 20 of the invention. The machine 20 incorporates as its principal components a plow 30 with an auger 40 located in advance of the plow. FIG. 1 illustrates the machine with the auger 40 and the plow 30 both lifted above ground level for transport of the machine from place to place.

Figure 2:
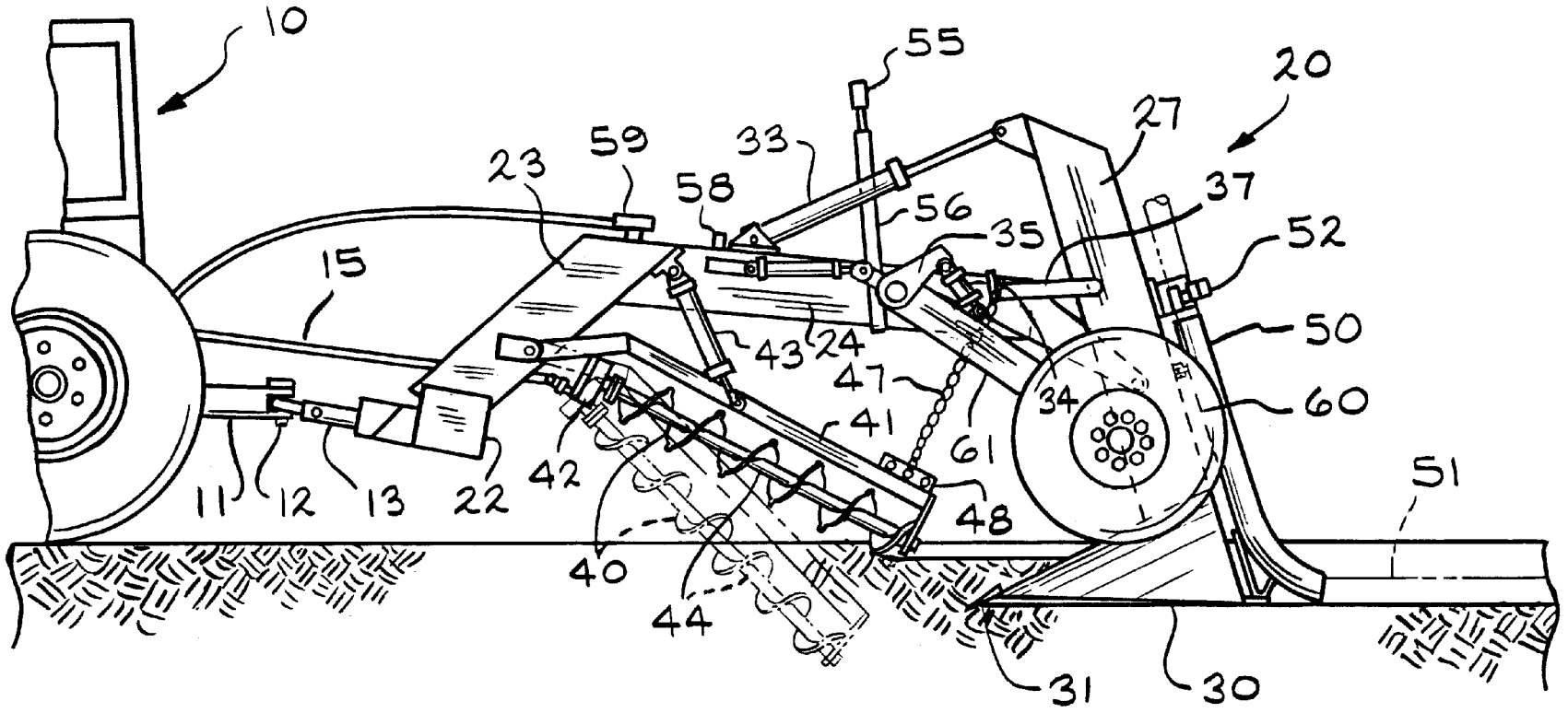
FIG. 2 is a side elevation view of the machine of the invention shown in FIG. 1 illustrating how the auger and plow are positioned during formation of a trench in which a flexible pipe is deposited.

The auger and plow are mounted on a frame support or superstructure 21 connected to a drawbar 22. The superstructure 21 includes a pair of upwardly extending parallel support arms 23 with a rearward extending support arm 24 connected therebetween. A pair of side by side plow support members 25 extend from the support arm 24 between which and on which a plow shank or arm 27 is mounted in pivoted relation. The plow arm 27 extends both upwardly and downwardly from its pivot 28 which permits the plow arm 27 to be swung so that the plow 30 can make cutting contact with the soil as shown in FIG. 2.

When the upper portion of the plow arm 27 is pushed about its pivot 28 to the rear of the machine by a hydraulic cylinder 33, the plow 30 which is generally right triangularly shaped with its flat bottom as one side of the triangle leading to a cutting edge is lowered into a soil cutting position. Correspondingly the auger 40 mounted in a support frame 41 is lowered into the soil cutting position by a hydraulic cylinder 43. Power for operation of the auger is supplied by a power takeoff shaft 15 extending from the tractor 10 to a speed changing gear drive unit 42 which supplies the power for rotation of the auger drive shaft 44.

Both the withdrawn plow and auger are transported on a pair of wheels 60 mounted on arms 61 connected in pivoted relation to the superstructure 21. Each of the wheels 60 can be pushed forward or moved backward about a pivot 62 by a respective one of a pair of hydraulic transport cylinders 32 mounted on opposite sides of the rearward extending support arm 24 of the superstructure 21. The transport cylinders incorporate bypass relief valves which allow them to act as biasing or spring-like mechanisms. When both wheels 60 are pushed far forward toward the tractor 10, they lift the superstructure 21 and correspondingly lift the plow 30 and the auger 40 into their raised positions for transport from place to place by the tractor 10.

While the machine as shown in the drawings depicting the invention do not show the conventional hydraulic oil supply cables connected to each of the hydraulic power cylinders incorporated in the machine, it will be understood by those knowledgeable in the art that the tractor for pulling the machine would have an oil pump for supply of fluid to each of the power cylinders 33 and 43 by way of their respective cables. Appropriate push button controls are provided in the tractor control panel which permit activation of each power component such as to lift the superstructure by positioning the wheels 10 by way of their its transport cylinders 32 as well as the power cylinders 33 and 43 to push both the plow and the auger respectively, into soil cutting positions. Similarly power for operation of the auger is supplied by a rotating take-off shaft 15 extending from the tractor under control by the tractor operator at the tractor control panel. The electrical control systems for the machine are also controllable by the operator by activation of solenoids such as a solenoid to raise a laser signal receiver mast 56 and a solenoid for control of a valve supplying oil to a tilt cylinder 34 of the machine.

FIG. 2 shows the trencher plow 30 and the auger 40 in operating positions in which the superstructure 21 is lowered by retracting the cylinders 32 to move the wheels 10 rearward. The auger can thus be lowered to a soil contracting level where its tip end can cut to a level slightly above the plow 30 which follows. The auger cylinder 43 during operation pushes the auger support frame 41 downwardly to cause the auger 40 to engage the soil and during rotation to loosen and toss the soil to one side of the line in which the trench is formed by the plow 30. The plow itself is positioned for cutting engagement with the loosened soil of the trench by the hydraulic cylinder 33 which as indicated pushes the plow downwardly about its pivot 28 after the wheels 60 are moved backwardly by their hydraulic transport cylinders 32. The hydraulic cylinder 33 which incorporates a two-way valve is controlled initially by the operator to push the plow into cutting contact with the soil following the auger and fix the depth of cut by the plow after which the plow rides or floats on its back undersurface with its front cutting edge or boot 31 raised or lowered by the cylinder 33 to modify the depth of cut. The auger cylinder 43 incorporates a pressure relief valve arranged so that it applies uniform pressure downwardly on the auger and thereby, in a sense, causing the auger to float as it cuts into the soil preparatory to the follow-up by the plow. The auger is thus in effect spring-like biased downwardly or floated and thus liftable independently over obstructions confronted, such as stones or existing pipe, in the path of the machine.

The auger is arranged to provide its advance preparatory cut a slight distance above the cutting boot 31 of the plow. In this respect the end of the auger is arranged to cut in the range of about 1 to 18 inches above the plow cut. To assure a uniformity of the auger relative to the plow, a mechanical connection, such as a flexible connection in the form of a chain 47 is provided between a longitudinal connecting arm 31 extending downwardly from a lateral projection on the plow arm 27 and a chain connecting mount 48 on the auger support frame 41. This connection provides a limit on the depth to which the auger may cut relative to the plow boot 31. That is, the chain connected between the connecting arm 37 and a selected one of a number of length determining positions of the chain mount 48 on the auger support frame 41, limits the depth of cut to which the auger 40 may extend relative to the plow. In this respect the auger cylinder 43 with its internal relief valve pushes the auger with a uniform pressure downwardly to the limit set by the chain 47. More specifically, the chain connection mount 48 is provided with a series of connection apertures to permit adjustment of the depth of cut by the auger as determined by which of the series of apertures the chain is connected to for establishment of a predetermined depth of cut desired relative to the following cut by the plow 30.

An additional feature of the machine of the invention is the provision of tilt adjusting means such as of a tilt cylinder 34 connected to one of the support arms 61 at the opposite sides of the plow support arm 24. By incorporation of this mechanism, when the superstructure 21 supporting both the plow and auger tilts to one side or the other, the tilt cylinder 34 is activated to lift or lower the side of the superstructure 21 to establish a non-tilt alignment of the machine. To sense and regulate tilt of the machine a level switch 59, such as a mercury level switch 59, is mounted in an upper region of the superstructure to sense when the machine tilts to one side or the other. This sends a signal to a solenoid in a solenoid pack 58 which sends a flow signal to the tilt cylinder 34 to bring the machine into level alignment as determined by the level switch 59.

The solenoid pack 58 also includes a solenoid for activation of the laser sensor support arm 56 to bring it into an upright position when the appropriate button is pushed in the tractor by the operator so that the laser sensor 55 can be positioned to sense the signal sent by a laser transmitter. Such a transmitter is usually mounted in the vicinity or the center of the general area, such as a field in which a trench is being cut. The grade of the trench to be cut is set by selection of a corresponding plane of rotation of the laser beam at the laser beam transmitter. The signal picked up by the laser signal receiver 55 on its support arm 56 thereby operates in conjunction with the transport cylinders 32 to set the level at which the plow 30 cuts into the soil. The auger 40 is correspondingly responsive to the signal by being pushed downwardly to the limit of depth allowed by the plow as determined by the chain connected to the plow connecting arm 37 mounted on the shank 27.

A flexible pipe 51 can be deposited directly in the trench being formed, by drawing the pipe from a source with a pair of feed rolls 52 driven such as by an orbital motor which rolls feed the flexible pipe through a feed tube 50 curved downwardly toward the rear of the trench to deposit the pipe into the newly formed trench. The rolls can be made more effective by having small rubber tires which provide frictional engagement with the flexible pipe to assure positive feeding of a pipe at the desired speed matched to the speed of advancement of the tractor.

As seen in FIG. 2 the auger may be moved downwardly to any of a number of positions in a range of angles. The auger depth however, is limited as described by the chain length selected to assure that the cut is above the cut made by the plow which follows the auger. The auger can accordingly remove soil cut by the plow below.

Figure 3:
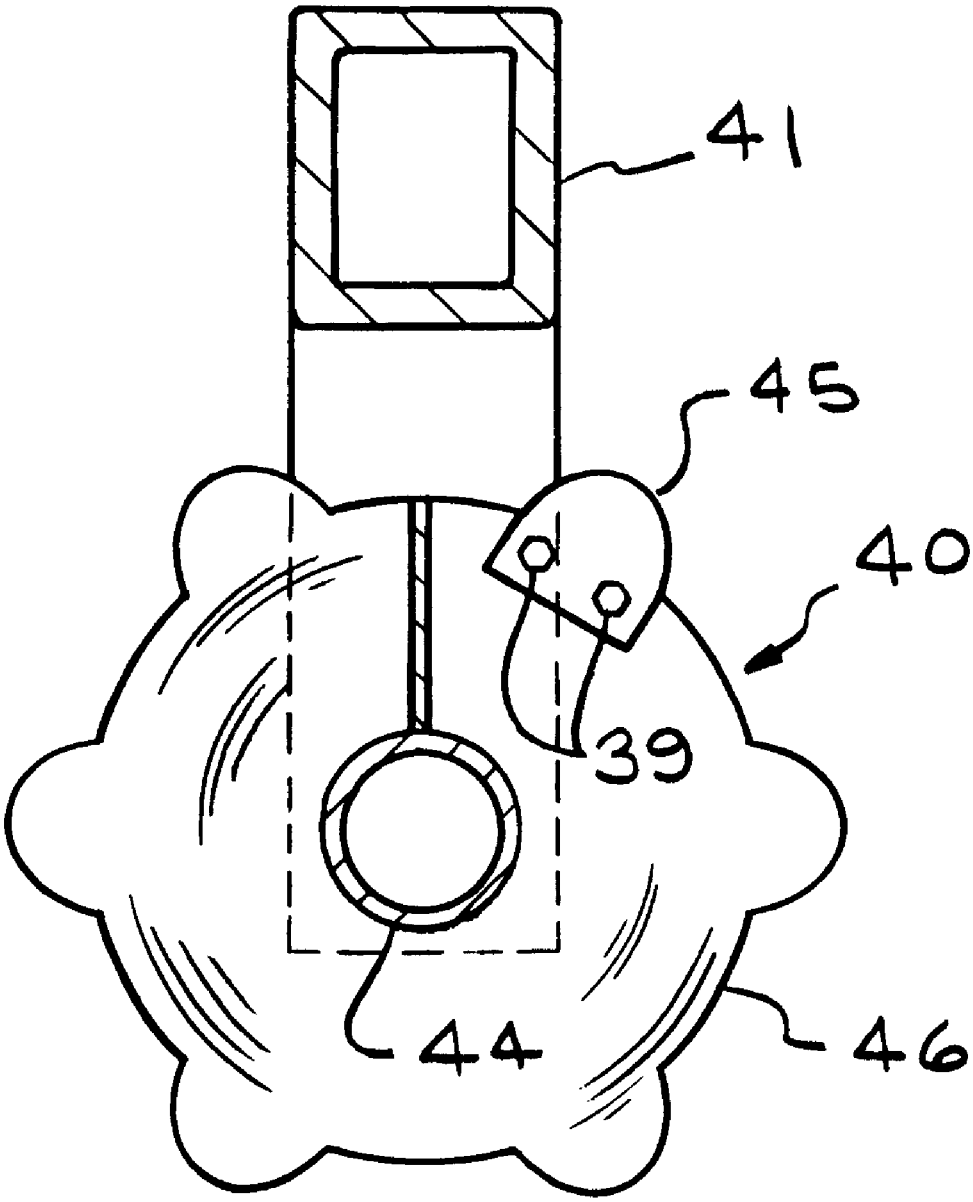
FIG. 3 is an enlarged cross sectional view of the auger of FIGS. 1 and 2 showing lobes spaced about the auger teeth.

FIG. 3 shows the construction of the auger with lobes 45 spaced about the angled auger teeth 46 distributed along the length of the auger drive shaft 34 which in turn is supported in the auger support frame 41. The lobes 45 can either be welded to the teeth 46 or can be made replaceable such as by being bolted by bolts 39 to the teeth 46. With these lobes matched to or appropriately angled to the auger teeth 46, the soil can be cut and thrown to both sides of the trench being formed for later coverage of the pipe being deposited by the machine. The auger by way of example can have a diameter of about 20 inches with about 6 lobes distributed about each tooth and with teeth spaced apart about 16 inches along a length of about 10 feet. The auger can be driven rotationally by a tractor power take off operating at about 1000 RPM which is preferably reduced by a speed reducer to the actual auger speed of about 145 PRM.

The boot 31 of the plow 30 is pushed into cutting position, by control of the two-way valve of the power cylinder 33 to cause it to exert a pressure for example of about 2800–2900 psi. The plow then cuts on its own as regulated by the laser transmitter which supplies a stream of grade cutting signals picked up by the laser signal sensor 55 mounted on its arm 56 on the support structure for the plow. The signal sensed regulate the power cylinder valve to modify the power cylinder pressure, for example of an average of about 1500 psi, to be applied to the plow support arm.

The auger 40 is pushed into soil cutting position by blocking the bypass relief valve of its power cylinder 43. The auger thereafter operates at a constant float pressure in cutting the soil. The auger can be adjusted to cut to a preselected depth in a range from about 1 to 18 inches above the plow boot and for example can be arranged with the system described to reach a depth of about 6 feet. As described the auger is limited in its cut by being connected to the plow arm such as by the chain 47 so that it cannot cut to a level lower than the preselected level just above the plow boot. Such an auger and plow arrangement for example can cut a trench about 23 inches wide. With these dimensions, tile length or continuous flexible pipe about 18 inches in diameter can be laid after the plow.

In operation the laser beam sensor translates the grade signal into pressure cylinder action to lower and lift the plow cut to the grade level set at the laser beam transmitter. Correspondingly the auger is lifted by the chain 47 or lowered by its cylinder 43 to the limit fixed by the connecting chain 47. In this regard the auger acts as a slave unit to the plow in loosening the soil but acts independently when obstructions are in the path of the auger. In such instances the auger can lift itself over an obstruction to be handled by the following plow. Although a chain is illustrated as a successfully operable connection form, it will be understood by those knowledgeable in the art that other connecting components may also fulfill the function such as a strap or a biased lever system.

The machine thus described is exemplary of the principles of the invention and it will be understood by those knowledgeable in the field that any number of auger and plow dimensions can be provided to form trenches of wider or narrower dimensions. The coverage of the pipe can be done after the pipe is laid and inspected for proper deposition, or can be covered directly by one or more drag blades drawn behind the machine 20.

It will be understood from the foregoing that many variations of the arrangement of my invention can be provided within the broad scope of principles embodied therein. Thus, while a particular preferred embodiment has been shown and described, it is intended by the appended claims to cover all such modifications which fall within the true spirit and scope of the invention.

What is claimed is:

1. Trench forming apparatus for forming a trench such as for drainage pipe comprising, a plow having a soil cutting boot for cutting and shaping a trench a longitudinal auger having helically distributed soil cutting teeth positioned to be pulled with an end in advance of said plow said plow being arranged to be pulled by a support arm above said auger pressure means for pressing said plow into a soil cutting and clearing position for forming a trench of desired width and depth said auger being adjustable in angle of orientation toward said plow boot, second pressure means for pressing said auger into a downward angled soil cutting position with said end above said plow boot, said auger being rotatable to cut and loosen soil in advance of said plow, rotary power means for rotating said auger.

2. Trench forming apparatus as set forth in claim 1 wherein said pressure means and said second pressure means are each oil pressure cylinders pressureable by an oil supply pump.

3. Trench forming apparatus as set forth in claim 2 wherein said oil pressure cylinder of said second pressure means incorporates a pressure relief valve enabling establishment during operation of uniform application of pressure to said auger.

4. Trench forming apparatus as set forth in claim 3 in which the pressure of the pressure cylinder for said plow is variable for increase and decrease in pressure for adjustment of the depth of cut of the plow in forming a trench.

5. Trench forming apparatus as set forth in claim 4 including grade setting apparatus comprising a laser unit adapted to providing a rotating signal which sets a plane of signal rotation corresponding to the predetermined grade of a trench to be cut.

6. Trench forming apparatus as set forth in claim 5 including means for sensing said laser signal and for adjusting the pressure applied by said pressure cylinder for said plow to cause the cut by said plow to correspond to said predetermined grade.

7. Trench forming apparatus as set forth in claim 1 wherein said auger includes cutting lobes mounted in spaced relation on its teeth effective during rotary operation to cut and throw loosened soil to the sides of a trench being formed.

8. Trench forming apparatus as set forth in claim 7 wherein said lobes are replaceably secured to the auger teeth.

9. Trench forming apparatus as set forth in claim 7 including pipe feeding means for drawing continuous flexible pipe from a source and guide means for guiding the pipe into a trench being formed.

10. Trench forming apparatus set forth in claim 9 in which said guide means comprises a tube shaped to deposit flexible pipe passed therethrough into the trench being formed.

11. Trench forming apparatus as set forth in claim 10 wherein said auger includes cutting lobes mounted in spaced relation on its teeth effective to cut soil and throw soil to at least one side of a trench being formed.

12. Trench forming apparatus as set forth in claim 11 including flexible mechanical means extending between said plow support arm and said auger to maintain the distance of cut of said auger over said plow as said apparatus is moved over soil to form a trench.

13. Trench forming apparatus as set forth in claim 12 in which the power means for pressing said lower end of said auger into soil cutting position imparts a uniform pressure to said auger whereby said auger is cushioned in downwardly biased relation with the soil and liftable over obstructions opposing the uniform pressure applied.

14. Trench forming apparatus as set forth in claim 11 in which said cutting lobes are replaceably secured to the teeth on which they are mounted.

15. Trench forming apparatus as set forth in claim 1 including mechanical connection means extending between said plow support arm and said auger whereby said end of said auger during operation is maintained in adjustably predetermined distance above said plow boot.

16. Trench forming apparatus as set forth in claim 15 wherein said mechanical connection means is flexible.

17. Trench forming apparatus as set forth in claim 15 wherein said mechanical connection means includes a chain adjustable in length in its connection between said plow support arm and said auger.

18. Trench forming apparatus as set forth in claim 1 including level sensing means associated with said plow for sensing tilt in lateral alignment tilt of said plow in operation and means for correcting such sensed misalignment.

19. Trench forming apparatus as set forth in claim 18 in which said means for correcting lateral misalignment of said plow is lift means adjustable up and down on one side of said plow arm.

20. Trench forming apparatus as set forth in claim 19 in which said lift means is a power cylinder automatically responsive to misalignments sensed by said level sensing means.

21. Trench forming apparatus for forming a trench for pipe laying comprising, a plow having a cutting boot for cutting and shaping a trench, a longitudinal auger having helically distributed teeth positioned in advance of said plow a support structure supporting said plow and said auger said plow having a support arm for pulling said plow extending from said support structure, said support arm overhanging said auger, said support arm and plow being downwardly positionable into a soil cutting position for said plow boot, power means, associated with said support arm for pressing said plow into soil cutting position for cutting a pipe trench, said auger being adjustably angled downwardly from said support structure toward a soil cutting position in which its lower end is above said plow boot, said auger being rotatable by means adaptable to take off of power from a tractor and having associated power means for pressing said lower end of said auger downwardly into a soil cutting position in advance of said plow.

22. A method of forming a pipe trench comprising cutting and loosening soil for a trench with a rotating auger, applying a uniform downward pressure on said auger to incline it downwardly with an end thereof at a lower level, throwing the loosened soil with the auger to both sides of a trench being formed, additionally cutting and clearing soil from the trench being formed with a plow said cutting and clearing by the plow extending under the cutting by said inclined auger, limiting the depth of cut by said auger to a predetermined level above the depth of cut by said plow, the lower level end of the auger being freely moveable above said predetermined level whereby said auger can pass over obstacles independent of the cutting action of the plow.

* * * * *